US011678122B2

(12) United States Patent
Brogan

(10) Patent No.: US 11,678,122 B2
(45) Date of Patent: Jun. 13, 2023

(54) SPEAKER

(71) Applicant: Hugh Brogan, Coventry (GB)

(72) Inventor: Hugh Brogan, Coventry (GB)

( * ) Notice: Subject to any disclaimer, the term of this patent is extended or adjusted under 35 U.S.C. 154(b) by 80 days.

(21) Appl. No.: 16/758,727

(22) PCT Filed: Oct. 23, 2018

(86) PCT No.: PCT/GB2018/053065

§ 371 (c)(1),
(2) Date: Apr. 23, 2020

(87) PCT Pub. No.: WO2019/081918

PCT Pub. Date: May 2, 2019

(65) Prior Publication Data

US 2021/0400391 A1 Dec. 23, 2021

(30) Foreign Application Priority Data

Oct. 23, 2017 (GB) ..... 1717413
Oct. 24, 2017 (GB) ..... 1717439

(51) Int. Cl.
*H04R 7/18* (2006.01)

(52) U.S. Cl.
CPC ..... *H04R 7/18* (2013.01)

(58) Field of Classification Search
CPC ..... H04R 7/18–24; H04R 7/16–26; H04R 2499/11; H04R 2499/13; H04R 2499/15; H04R 2400/07; H04R 7/045
See application file for complete search history.

(56) References Cited

U.S. PATENT DOCUMENTS 6,324,052 B1 * 11/2001 Azi ..... G06F 1/1616 361/679.23
6,324,294 B1 11/2001 Azima
9,660,596 B2 5/2017 Labs
2003/0047377 A1 * 3/2003 Proni ..... H04R 7/20 181/172
2009/0010480 A1 * 1/2009 Ding ..... H04R 7/20 381/395
2013/0058521 A1 * 3/2013 Davidson ..... H04R 7/18 381/398
2016/0219353 A1 * 7/2016 Whitwell ..... H03F 3/181
2017/0289694 A1 * 10/2017 Choi ..... H04R 7/045

FOREIGN PATENT DOCUMENTS

DE 196 31 293 A1 4/1998
DE 19631293 A1 * 4/1998 ..... H04R 9/041
EP 1484 941 A1 12/2004
GB 2 387 500 A 10/2003
JP 2017 011395 A 1/2017
WO 98/43464 A1 10/1998

OTHER PUBLICATIONS

International Search Report, dated Feb. 8, 2019, issued in International Application No. PCT/GB2018/053065.

* cited by examiner

*Primary Examiner* — Sunita Joshi
(74) *Attorney, Agent, or Firm* — Saul Ewing LLP

(57) ABSTRACT

A speaker comprises an electroacoustic transducer diaphragm which is mounted between or suspended from multiple suspension pins or suspension components. The suspension pins or suspension components provide mechanical support and acoustic isolation to the diaphragm.

33 Claims, 8 Drawing Sheets

SPEAKER

CROSS REFERENCE TO RELATED APPLICATIONS

This application claims the priority of PCT/GB2018/053065, filed on Oct. 23, 2018, which claims priority to GB Application No. GB1717413.7, filed on Oct. 23, 2017, and GB Application No. GB1717439.2, filed on Oct. 24, 2017, the entire contents of each of which being fully incorporated herein by reference.

BACKGROUND OF THE INVENTION

1. Field of the Invention

The invention relates to audio speakers with moving diaphragms, including speakers with speaker cones and also distributed mode loudspeakers.

2. Description of the Prior Art

Conventional speakers typically consist of a speaker cone suspended around its periphery using a "roll top" suspension system which is attached/bonded to the cone and to a frame. Whilst this technique is widely used, it is difficult for speaker designers and manufacturers to implement as moulding roll top suspension systems requires high accuracy in both the moulding of the suspension and in affixing the roll top suspension to the cone and the frame to ensure the speaker delivers the required performance.

A further complication with roll top suspension systems for speaker designers is that when the cone is mounted vertically, at least a proportion of the mass of the cone is supported by the suspension. This means that the top of the suspension is expanded whilst the lower part of the suspension is in compression. This distorts the shape of the suspension, which can have detrimental effects on the linear pistonic action of the speaker cone as the compliance of the suspension is no longer uniform around the cone's periphery.

Speaker designers can offset this with the design of the roll top suspension and by adapting the material specification of the roll top suspension at different points around the periphery of the cone. But this is a complex and somewhat empirical process and also leads to complex and difficult manufacturing processes.

Typical cone speakers require that when an audio signal is applied to the speaker, the cone moves by the same amount in both directions. However the trend in consumer electronics, specifically mobile devices, smartphones, tablet computers, MP3 players etc. is for speakers to be designed with very small and thin form factors. This can place limits on the excursion that the speaker cone is allowed to travel. In many cases, the performance and integration of the speaker can be optimised if the excursion is asymmetrical. However designing and manufacturing a small form factor speaker with asymmetrical excursion is difficult and complex. Audio system designers can assist with this by using complex electronics and software that can monitor the displacement of the speaker by measuring it's dynamic impedance and adjusting the system amplifier's output to limit excursion in a specific direction. But this results in additional system costs, is wasteful of power in a portable device and is complex to implement.

Whilst in general pistonic speakers are circular in design, some pistonic speakers, such as those used for high frequency sound reproduction ("tweeters") are different shapes, such as rectangles etc. This creates additional problems for speaker designers, as due to the non-uniformity of opposing sides of the speaker (i.e. the long edge vs the short edge as in the case of a rectangle) the difference in the length of these sides results in unequal suspension compliance for a given material and design. Therefore, when the cone moves, it will twist and torque the speaker suspension, creating distortion in the audio signal (remembering that for proper action the suspension must be equally complaint on all sides to allow for uniform pistonic action). This again can be offset by design or material specification, but this creates a more complex design, leading to, amongst other solutions, either different sectioning of the suspension of the long and short sides, or different material specification for the suspension along different edges, all adding to the manufacturing complexity of the speaker.

Whilst the above background shows examples of the problems associated with pistonic speakers, the present invention has applications in DML (distributed mode loudspeakers) as well. By way of background, we will discuss the basics of DML loudspeakers and their associated problems.

DML loudspeaker differ from conventional pistonic loudspeakers in that they do not rely on pistonic movement to produce sound. Rather DML speakers utilise motors, typically moving coil transducers or piezo electric transducers, which are attached to a panel and driven by an audio source to transmit bending wave energy into the panel. The panel is a light, stiff and (typically) flat panel. The bending waves excite resonant modes within the panel: the excitation of these modes above and in some cases below the coincidence frequency of the panel are coupled into air and produce sound. DML teaching as detailed in Patent Application WO97/09842 describes how, for best performance, DML panels and transducers should be designed and transducers located to maximise the number of resonant modes and that these modes must be evenly spaced across the panel to avoid clustering and associated dead spots where no energy is coupled into air. Patent Application WO97/09842 further describes how the use of a roll top suspension can be used to enhance the modal behaviour of the panel. Given the nature of bending waves and the desire to enhance certain modes within the panel and to distribute these evenly across the panel, a roll top suspension has its limitations. In practice, a single roll top suspension is not ideal, as the panel suspension requirements of the panel are not uniform around its periphery, requiring different compliance and or attachment to the panel to enhance the modal behaviour of the panel. This is not easily achieved, requiring either complex design and manufacturing of a suspension with asymmetrical and non-uniform compliance and also partial attachment at certain locations along the periphery of the panel.

Aspect of the present invention are used to greatly offset the complex design and manufacturing process required to create speaker suspension systems and specifically are of great benefit for use in a DML, where non-uniform suspension and damping of the panel is in many cases desirable and in some cases essential.

SUMMARY OF THE INVENTION

The invention is a speaker comprising an electroacoustic transducer diaphragm which is mounted between, or suspended from, multiple suspension pins or suspension components.

Optional features include one or more of the following:

The suspension pins or suspension components provide mechanical support and acoustic isolation to the diaphragm.

The diaphragm is suspended from or between a support frame by the multiple suspension pins or suspension components The suspension pins or suspension components are the only, or substantially only, means of connecting or mounting the diaphragm to the support frame.

The suspension pins or suspension components provide both mechanical support for the diaphragm and damp unwanted oscillations passing from the diaphragm into the support frame and back into the diaphragm.

The diaphragm moves pistonically

The diaphragm is a panel

The diaphragm is a DML diaphragm or panel

The suspension pins or components each have a predefined compliance, stiffness, or flexibility The suspension pins or components each have a predefined compliance, stiffness, or flexibility configured to control the movement, oscillation or other behaviour of the diaphragm Some suspension pins or components are configured with a different compliance, stiffness, or flexibility than other suspension pins or devices Some suspension pins or components are mounted with one end in a clamp and are configured to contact a part of the diaphragm at their other end.

Some suspension pins or components are mounted with one end in or on the frame and are configured to contact a part of the diaphragm at their other end.

Some suspension pins or components are positioned on one face of the diaphragm and other suspension pins or devices are positioned on an opposing face of the diaphragm The suspension pins or components provide any one or more of the following types of suspension: free, semi-supported or clamped.

The suspension pins or components that provide clamped suspension are pre-loaded.

The suspension pins or components are made from an elastomeric material, such as foam or rubber, with a compliance in the range Shore 0 grade 00 to Shore D grade 100; and preferably between Shore 00 40 and Shore 00 80.

Compliance is axial and/or rotational compliance

At least some suspension pins or components are positioned at or substantially close to nodes.

the suspension pins or components are configured with a height selected to control the movement or other behaviour of the diaphragm.

The suspension pins or components are configured with a compliance and/or mass selected to control the movement or other behaviour of the diaphragm.

The suspension pins or components are configured with a surface area of contact with the diaphragm that is selected to control the movement or other behaviour of the diaphragm.

The suspension pins or components are configured with an external shape that is selected to control the movement or other behaviour of the diaphragm The suspension pins or components are configured with an external construction that is selected to control the movement or other behaviour of the diaphragm.

The suspension pins or components are configured with a hollow internal construction that is selected to control the movement or other behaviour of the diaphragm.

The position of at least some suspension pins or components provides enhanced modal behaviour.

The speaker also includes damping pins that reduce unwanted clustering of nodes.

Different damping pins are of different design, materials and have different compliance and or suspension characteristic A damping pin or a plurality of damping pins are placed into the frame or an element attached to the frame in which the damping pin is positioned to alter the modal behaviour of the diaphragm.

The position of at least some suspension pins or components provides reduced clustering of modes The position of at least some suspension pins or components provides a more even suspension to the spacing of modes with frequency across the panel At least some suspension pins or components are formed as strips of components.

Suspension characteristics are tuned for either forward excitation and/or reverse excitation Suspension pins of different design and compliance serve to limit the excursion of the speaker to a different degree in forward or reverse excursion and in different positions across the area of the speaker.

Bosses are used in the frame and/or the clamp ring

The frame has bosses whose height and shape determine the position of the diaphragm The clamp ring has bosses whose height and shape may determine the position of the diaphragm.

The frame has bosses whose height determines the distance between the frame and the diaphragm and the preload of the suspension pins on the diaphragm The clamp ring has bosses whose height determines the distance between the clamp ring and the diaphragm and the preload of the suspension pins on the diaphragm.

Frame is made of metal, rubber, glass, plastic, carbon fibre, Kevlar or a composite of these materials The clamp is made of metal, rubber, glass, plastic, carbon fibre, Kevlar or a composite of these materials A DML panel is made of paper, wood, metal, glass, plastic, carbon fibre, kevlar or a composite of these materials A speaker cone is made of paper, wood, metal, glass, plastic, carbon fibre, kevlar or a composite of these materials The diaphragm includes a dynamic speaker cone.

The diaphragm includes a dynamic speaker cone diaphragm that is circular, square or rectangular The diaphragm includes a panel of a DML, or distributed mode loudspeaker.

The speaker is mounted in a smartphone, mp3 or other personal digital music player, or smartwatch or other type of portable, personal device The speaker is mounted in a laptop or desktop device or automotive system.

The speaker is mounted in a car.

The speaker is mounted in a device that is optimised for thinness.

The term electroacoustic transducer diaphragm should be expansively construed to cover any device that can be used to generate sound, and hence any sort of speaker diaphragm. It covers also any device that picks up sound, and hence covers any sort of microphone. All of the above features apply also to a microphone. A second aspect is therefore a microphone comprising an electroacoustic transducer diaphragm which is mounted between, or suspended from, multiple suspension pins or suspension components.

BRIEF DESCRIPTION OF THE DRAWINGS

Implementations of the invention will be described, referring to the following Figures.

DETAILED DESCRIPTION

An implementation of the invention is a speaker assembly in which the cone or panel or other form of diaphragm is suspended on a series of discrete complaint suspension components, thereby providing a damped movement to that diaphragm, or otherwise controlling the oscillations of that diaphragm.

Each point or node at which the suspension components are placed can be associated with a suspension component with an optimised compliance, thereby allowing the vibration, frequency response and/or excursion of a speaker diaphragm to be specifically damped or otherwise controlled at different points, around its perimeter or within its perimeter, to reduce (in the case of a conventional speaker) unwanted resonances in the speaker or enhance (in the case of a DML) the resonant behaviour of the speaker, thereby improving its performance.

Figure 1:
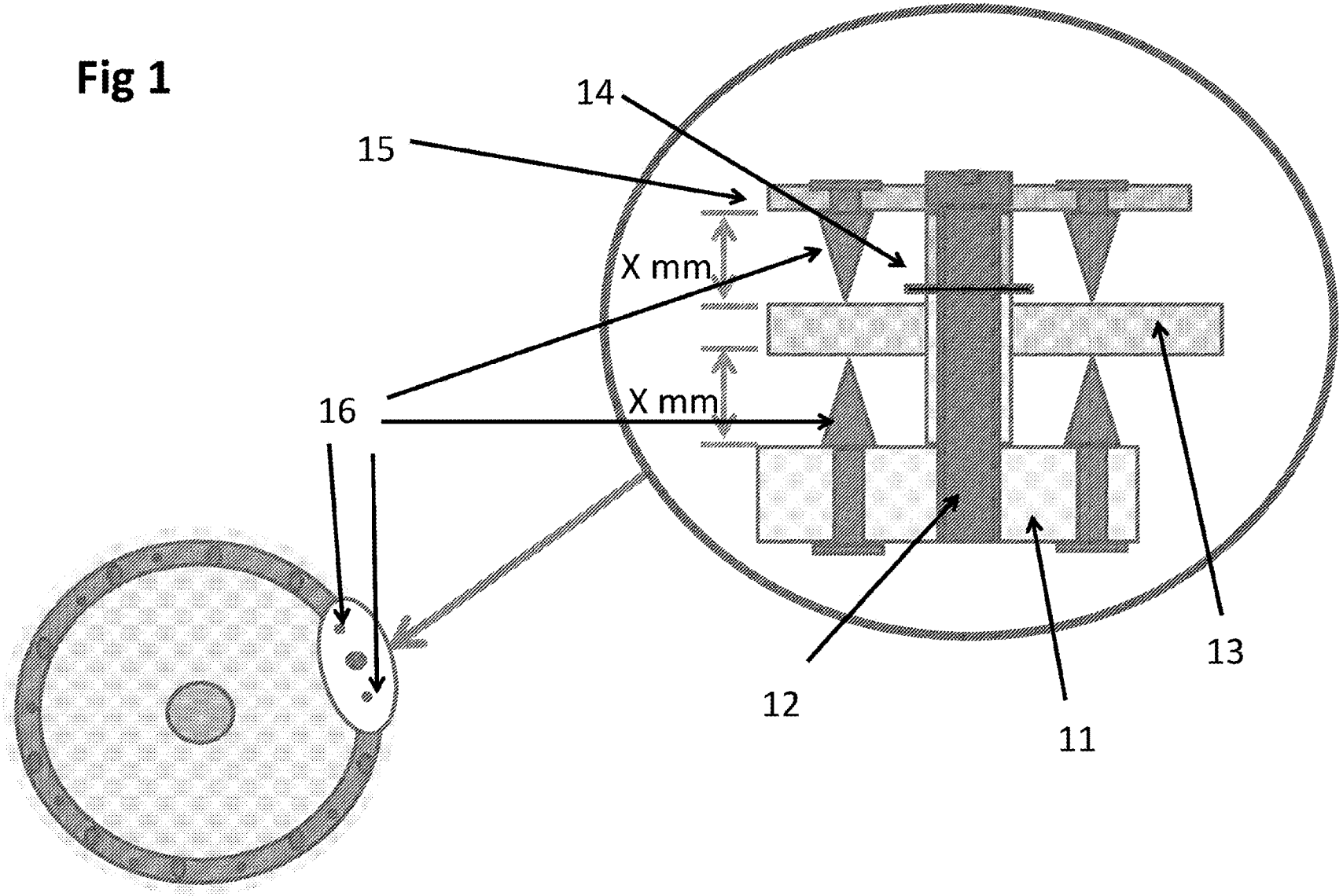
FIG. 1, which shows a schematic of a circular speaker cone mounted using suspension pins.

FIG. 1 shows a schematic for a pistonic speaker assembly: the speaker cone or diaphragm is mounted in a Frame (11) into which a plurality of suspension pins (16) have been placed. The pins (16) may be individual pins or formed in strips and can be either inserted or molded into the frame (11). Each of the suspension pins may have the same physical design and/or material specification, or a different design and/or material specification as required to alter the suspension characteristics of the pin and to suspend the speaker cone diaphragm (13).

The speaker cone (13) is placed into the frame (11) and aligned on to bosses within the frame to ensure that the cone is correctly positioned in respect of the suspension pins, which may be designed to give different compliance and other characteristics at different points around the cones' periphery.

A clamp ring (15) is attached to the frame, into which suspension pins (16) have been inserted/molded. The clamp ring may have bosses which align with bosses in the frame to ensure the suspension pins, which may have different compliance or other characteristics at different locations on the clamp ring, are correctly orientated with respect to the speaker cone and therefore the required suspension characteristics are aligned in the correct position in respect of the speaker cone and the overall speaker assembly. Fixings such as screws (12), which can be advantageously placed to provide the correct strength and robustness to the assembly and to enhance acoustic performance, are then used to attach the clamp ring to the frame.

The boss heights on both the frame and the clamp ring may be set to ensure the preload on the suspension pins is set correctly in steady state conditions. It is envisaged that a compressible washer (14) may be used to provide acoustic isolation between the clamp ring and the frame.

Figure 2:
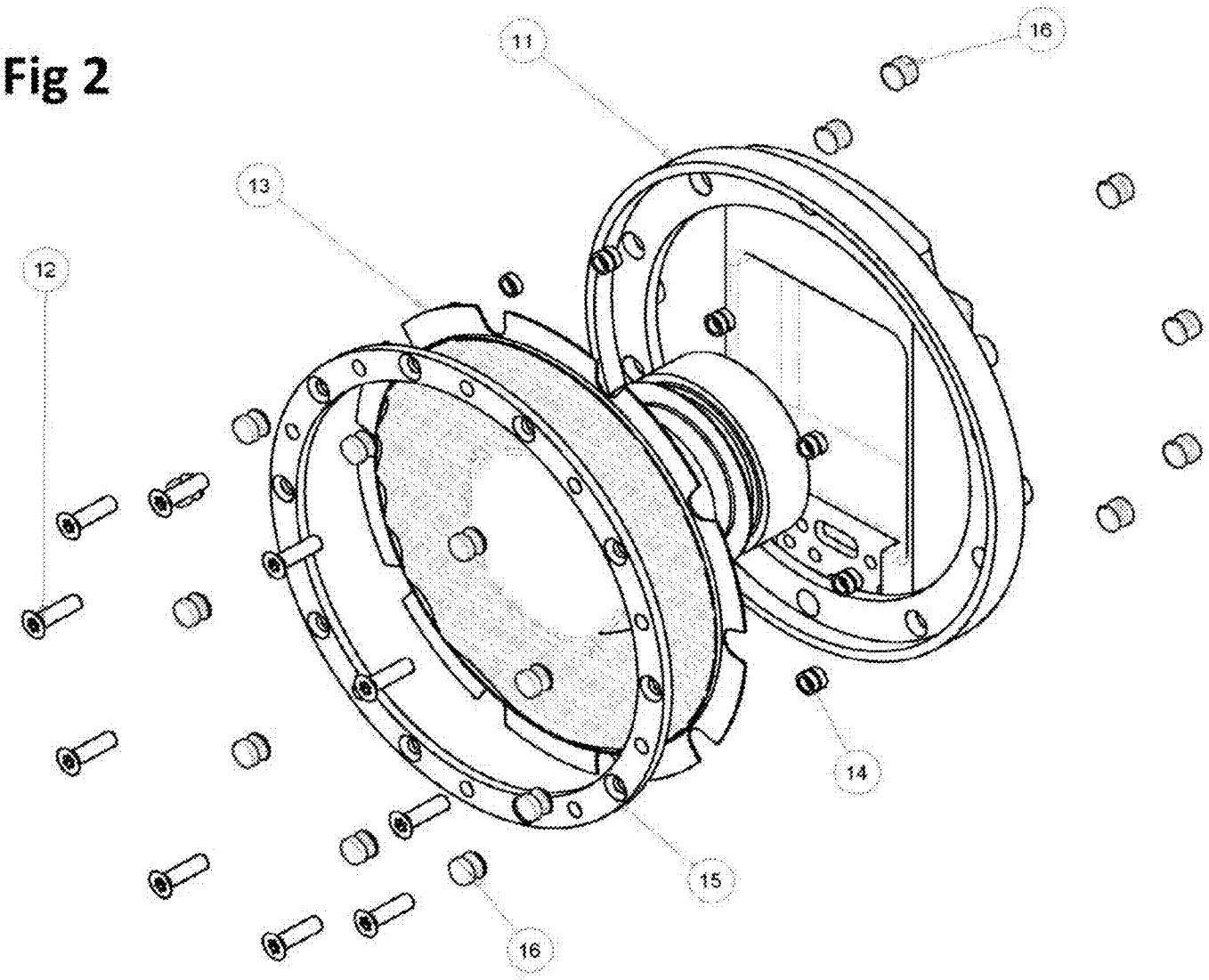
FIG. 2 is an exploded perspective view of a development rig used for developing a circular speaker cone mounted using suspension pins.
Figure 3:
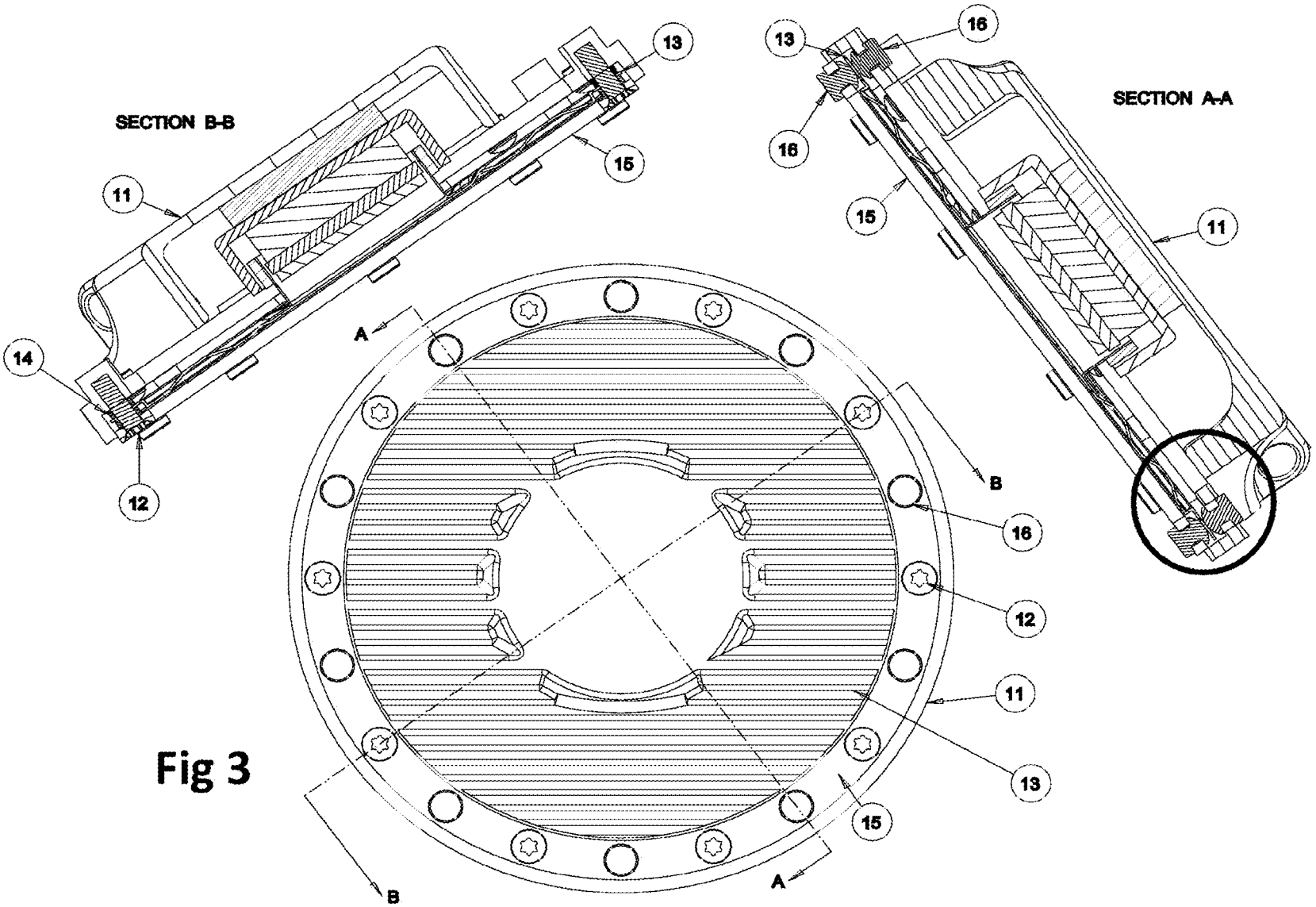
FIG. 3 are plan and cross section views of the development rig shown in FIG. 2.
Figure 4:
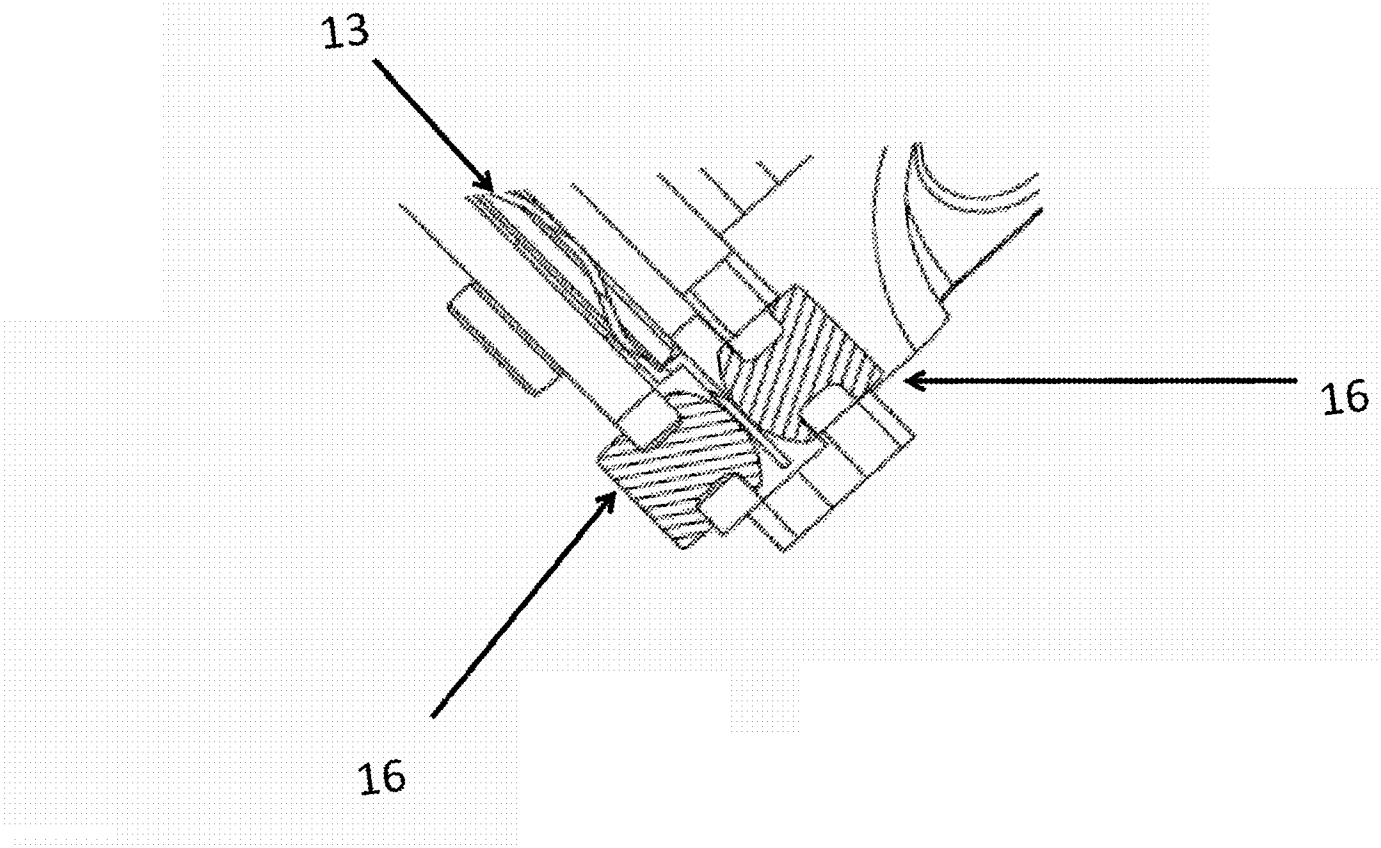
FIG. 4 is an enlarged portion of the cross section view AA shown in FIG. 3 that depicts more clearly the speaker cone suspended between suspension pins.

FIGS. 2-4 are engineering drawings for a development rig for this system, retaining the same integer numbering as FIG. 1. FIG. 4 is enlargement of the circled portion of Section AA in FIG. 3, and shows more clearly how the speaker cone diaphragm 13 is sandwiched between suspension pins 16.

The novel design and arrangement of these components produces multiple benefits for speaker designers, speaker manufacturers and consumers. One of the many benefits for designers is that speakers that require suspension can have the suspension characteristics tuned for either forward excitation and or reverse excitation to different degrees. This is especially convenient when designers are designing speakers where there is a requirement for asymmetry of mounting position or the space either in front or behind the cone/panel is limited such as in portable devices. By using the present invention to adjust for asymmetry, it can help designers simplify baffling arrangements and reduce the back volume required for good performance, resulting in smaller portable devices, which is beneficial for consumers.

The speaker cone, when mounted vertically does not rely on a roll top suspension for partial lateral support, thereby ensuring the suspension geometry is constant and not preloaded by the weight of the cone and therefore producing a more consistent performance for consumers regardless of how or in what the position the speaker is placed when listening to it.

Bosses are used in the frame (11) and/or the clamp ring (15) and these can be different shapes or keyed to align with similar shapes in FIGS. 1-4, the cone speaker (13), or FIG. 5-8, the DML speaker panel or diaphragm. This ensures that the speaker when assembled can be correctly positioned to take advantage of different suspension pins and their associated characteristics, which can be matched more closely to the cones/panels physical characteristics and or modes, resulting in higher performance of the speaker assembly which is of benefit to consumers and also a more consistent manufacturing process, which is of benefit to manufacturers.

The speaker is easier to manufacture than typical "roll top" suspension as used in many speakers, as the suspension does not have to be bonded to the speaker cone/panel, greatly simplifying the manufacturing process and the investment in capital equipment necessary to perform such bonding.

Suspension pins can be placed into the frame or clamp ring either individually or in strips, which is a far less complex process requiring less capital investment for a speaker manufacturers.

Figure 5:
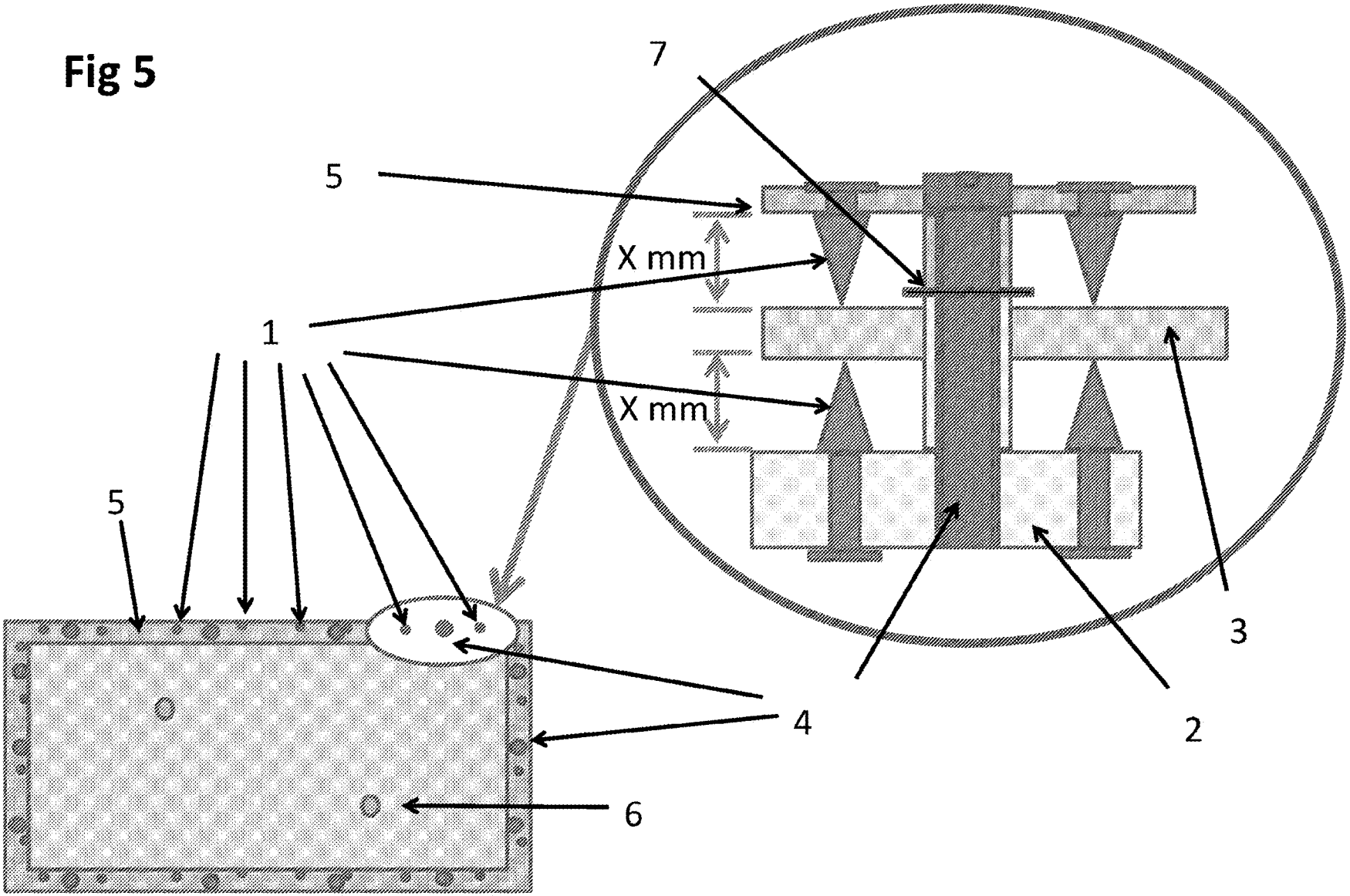
FIG. 5 is a schematic of a rectangular DML speaker panel mounted using suspension pins.
Figure 6:
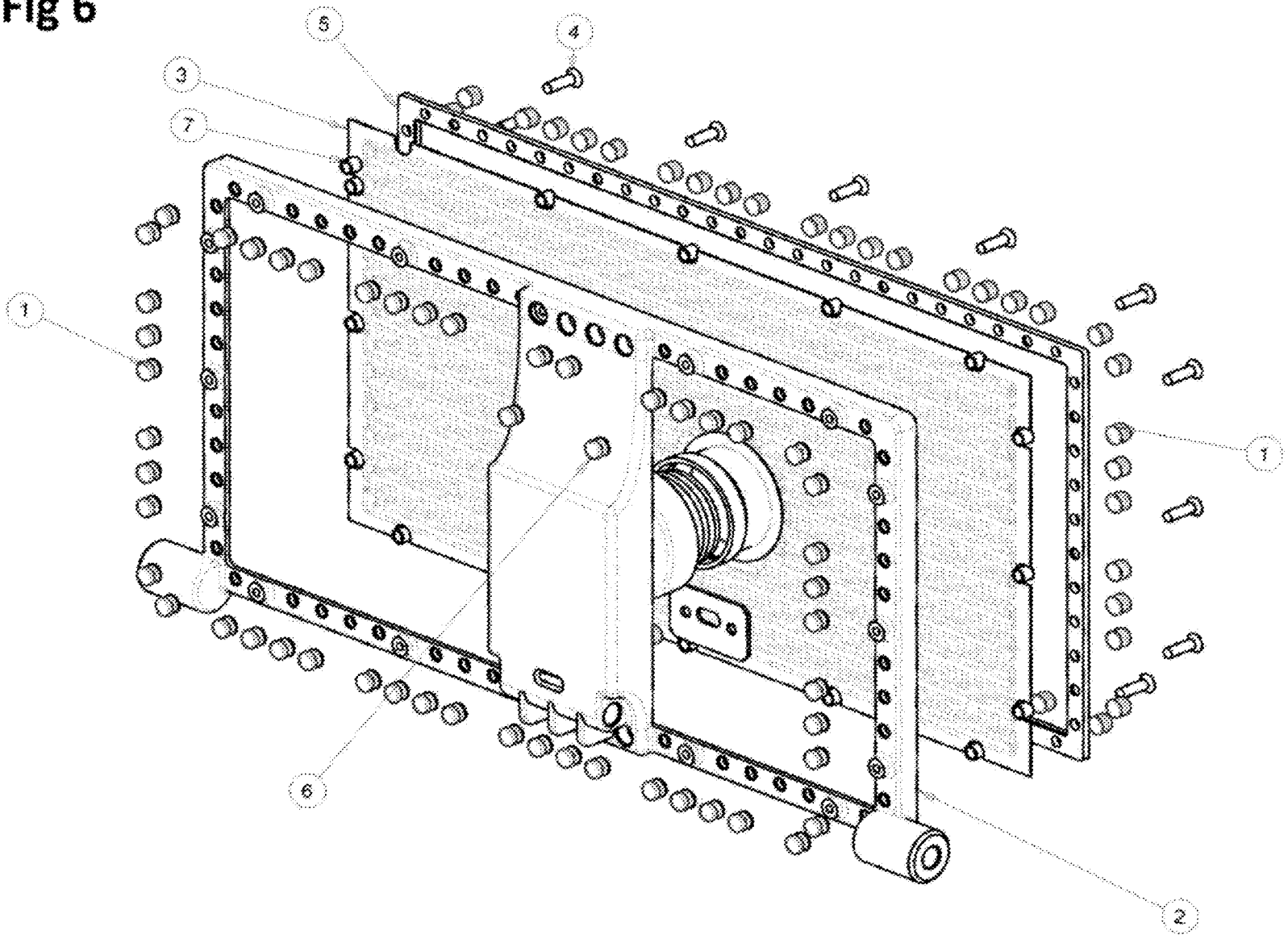
FIG. 6 is an exploded perspective view of a development rig used for developing a rectangular DML speaker panel mounted using suspension pins.
Figure 7:
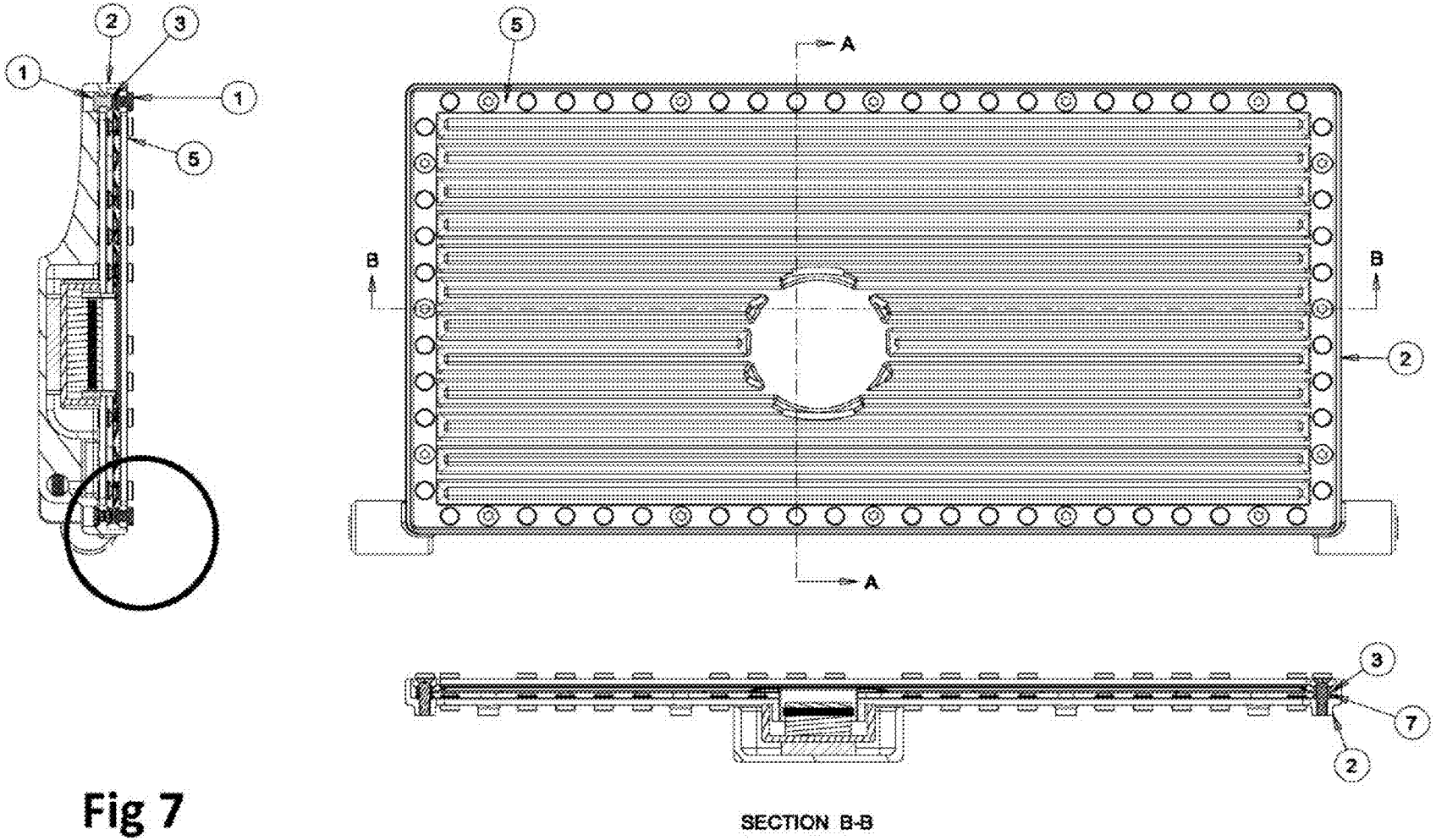
FIG. 7 are plan and cross section views of the development rig shown in FIG. 6.
Figure 8:
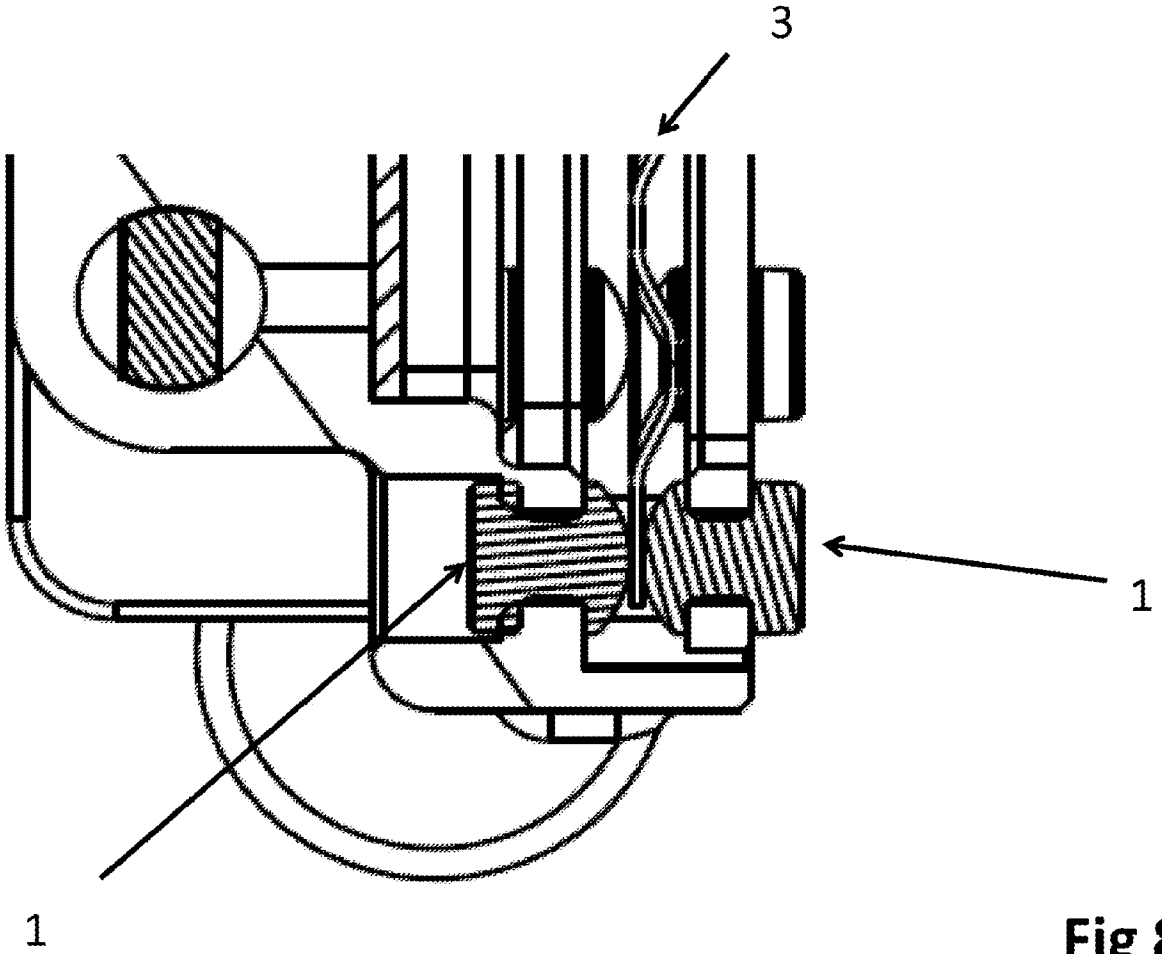
FIG. 8 is an enlarged portion of the cross section view AA shown in FIG. 7 that depicts more clearly the DML speaker panel suspended between suspension pins.

In respect of DML speakers, FIG. 5-7 shows a schematic for a typical rectangular DML speaker with a frame (2) into which a plurality of suspension pins (1) are inserted. A DML panel or diaphragm (3) is assembled to the frame and may be aligned on bosses in the frame. A clamp ring (5) which has a plurality of suspension pins (1) inserted into it, is attached to the frame. The frame and clamp ring may have bosses that are strategically positioned empirically or mathematically derived to provide good acoustic performance and strength/robustness to the speaker assembly. The clamp ring bosses (which may align with bosses in the frame) can be configured to ensure that suspension pins inserted into the clamp ring are correctly orientated in respect of the frame and the panel. Fixings, such as screws (4) may be inserted into the frame and secured against the clamp ring to secure and clamp, the clamp ring and the suspension to the panel. The height of the bosses is determined to ensure that the suspension is preloaded such the panel performs well as a DML speaker. A compressible washer (7) may be used between the frame bosses and clamp ring bosses to acoustically isolate/improve the performance of the frame and the clamp ring. FIG. 8 is an enlargement of the circled portion of the section AA in FIG. 7; it shows the DML panel 3 sandwiched between suspension pins 1.

The use of this invention in DML loudspeakers confers many of the benefits as described above for pistonic loudspeakers. It should be noted however that the invention delivers additional benefits for speaker designers, manufactures and consumers which relate to specific characteristics of said DML speakers.

In reference to DML teaching, it is advantageous for suspension systems to enhance modal behaviour by suspending the panel at different points around it's periphery. Modal behaviour and hence performance can be enhanced by suspending the edges of the panel on modal lines and in other specific areas to reduce clustering of modes and to create a more even distribution of the spacing of modes with frequency across the panel. The panel modal behaviour can be enhanced by applying different suspension modes, either clamped, simply supported or free at different locations around the periphery of the panel. This is very difficult and complex to achieve with a roll top suspension as it requires the compliance and other characteristics of the roll top suspension to be different along its length, which implies non-uniformity. This would need either design and or material change at different points along the roll top suspension.

It should be noted that for small panels <0.1 sq mtrs modal lines within the panel can be spaced in very close proximity to one another approx 1-5 mm apart. It is therefore a compromise to use a roll top suspension as a roll top suspension system with high differences in compliance and clamping with a spacing of a few mm's results in a blended compliance over said area, which is not ideal to deliver the best performance with respect to DML.

A further disadvantage of a roll top suspension in a DML is that typical DML speakers as taught in Patent Application WO97/09842 have an out of square aspect ratio to assist in promoting good modal behaviour. If a roll top suspension is applied to such an out of square member then differences in the length and width of the panel will create greater or lesser displacements along the non-uniform panel edges. This uneven displacement will twist the suspension, creating torque vectors in the panel to which it is attached and distortion of the audio signal that is being reproduced, unless the design and or materials properties of the suspension along the long and shorter edges of the panel are adjusted to compensate for this. This results in both a very complex design and a complex manufacturing of the suspension and the speaker. An implementation of the present invention solves both of these problems in a novel manner. In respect of the first problem, providing either clamped, semi supported or free boundary mounting conditions for the panel, it will be clear to the reader and from FIG. 5-8 that by altering the design/compliance of individual suspension pins, it is possible to vary the edge mounting conditions for a panel from clamped to simply supported and to free (ie no suspension pin is inserted) with very close proximity to each other, allowing for much greater control over the suspension of the panel and to fully optimise the suspension to achieve best modal behaviour. This can be achieved very simply by inserting suspension pins with different compliance, either through design (for example a hollow suspension pin) or through material selection in either the frame or the clamp ring or both. Suspension pins can be placed with spacing in the range of microns to mm's from one another, allowing designers great freedom and fine control of the suspension and behaviour of the panel which is essential for good sound reproduction and has not been able to be achieved to date with roll top suspensions.

For manufacturers the use of suspension pins greatly simplifies the design of high performance DML speakers as it does not require the design, molding and bonding of a composite/multi profile roll top suspension system which is expensive to make and is ultimately compromised in performance. A further benefit of an implementation of the present invention is that the problems associated with suspension twisting and the corresponding effect that this has on the panel and the sound reproduction are avoided because the compliance of individual suspension pins can be tuned along the length and width of the panel to compensate for the change in forces applied to the different length sides and to avoid torque and twist being sent in to the panel and to avoid the corresponding twist of the roll top suspension and the associated impact on performance.

The frame (2) itself may have damping pins (6) inserted into it at beneficial locations; these damping pins may or may not be in contact with the panel at rest in various locations. These damping pins, when in contact with the panel during operation of the speaker, serve to change the modal behaviour of the panel during such operation to improve the modal behaviour of the panel to reproduce audio.

The invention claimed is:

1. A speaker comprising an electroacoustic transducer diaphragm and multiple suspension pins or suspension components, in which the electroacoustic transducer diaphragm is mounted between the multiple suspension pins or suspension components, in which the multiple suspension pins or suspension components provide mechanical support and acoustic isolation to the electroacoustic diaphragm, in which at least some of the suspension pins or components are configured with a height selected to control the movement or acoustic behaviour of the diaphragm.

2. The speaker of claim 1 including a support frame, in which the electroacoustic transducer diaphragm is suspended from or between the support frame by the multiple suspension pins or suspension components.

3. The speaker of claim 2, in which the suspension pins or suspension components are the only, or substantially only, means of connecting or mounting the diaphragm to the support frame.

4. The speaker of claim 2, in which the suspension pins or suspension components damp unwanted oscillations passing from the diaphragm into the support frame and back into the electroacoustic transducer diaphragm.

5. The speaker of claim 1, in which the diaphragm moves pistonically.

6. The speaker of claim 1, in which the diaphragm is a DML diaphragm or flat panel, or in which the diaphragm is a flat panel.

7. The speaker of claim 1, in which the suspension pins or components each have a predefined compliance, stiffness, or flexibility; or in which the suspension pins or components each have a predefined compliance, stiffness, or flexibility configured to control the movement, oscillation or acoustic behaviour of the diaphragm.

8. The speaker of claim 1, in which at least some suspension pins or components are configured with a different compliance, stiffness, or flexibility than other suspension pins or devices.

9. The speaker of claim 1, in which at least some suspension pins or components are mounted with one end in a clamp and are configured to contact a part of the diaphragm at their other end.

10. The speaker of claim 2, in which at least some suspension pins or components are mounted with one end in or on the support frame and are configured to contact a part of the electroacoustic transducer diaphragm at their other end.

11. The speaker of claim 1, in which at least some suspension pins or components are positioned on one face of the diaphragm and other suspension pins or devices are positioned on an opposing face of the diaphragm.

12. The speaker of claim 1, in which the suspension pins or components provide any one or more of the following types of suspension: free, semi-supported or clamped.

13. The speaker of claim 12 in which the suspension pins or components that provide clamped suspension are preloaded.

14. The speaker of claim 1, in which the suspension pins or components are made from an elastomeric material, such as foam or rubber, with a compliance in the range Shore 0 grade 00 to Shore D grade 100 or in the range Shore 00 40.

15. The speaker of claim 1, in which at least some of the suspension pins or components have a predefined compliance that is an axial and/or rotational compliance.

16. The speaker of claim 1, in which at least some suspension pins or components are positioned at or substantially close to nodes.

17. The speaker of claim 1, (i) in which at least some of the suspension pins or components are configured with a compliance and/or mass selected to control the movement or other behaviour of the diaphragm; or (ii) in which at least some of the suspension pins or components are configured with a surface area of contact with the diaphragm that is selected to control the movement or acoustic behaviour of the diaphragm; or (iii) in which at least some of the suspension pins or components are configured with an external shape that is selected to control the movement or acoustic behaviour of the diaphragm; or (iv) in which at least some of the suspension pins or components are configured with an external construction that is selected to control the movement or acoustic behaviour of the diaphragm; or (v) in which at least some of the suspension pins or components are configured with a hollow internal construction that is selected to control the movement or acoustic behaviour of the diaphragm; or (vi) in which the position of at least some suspension pins or components provides enhanced modal behaviour.

18. The speaker of claim 1, in which the speaker also includes damping pins that reduce unwanted clustering of nodes.

19. The speaker of claim 1, the speaker including differing damping pins, in which different damping pins are of different design, materials and have different compliance characteristic.

20. The speaker of claim 2, the speaker including damping pins, (i) in which a damping pin or a plurality of damping pins are placed into the support frame or an element attached to the support frame, in which the damping pin is positioned to alter the modal behaviour of the diaphragm, or in which the damping pins are positioned to alter the modal behaviour of the diaphragm; or (ii) in which the position of at least some suspension pins or components provides reduced clustering of modes; or (iii) in which the position of at least some suspension pins or components provides a more even spacing of modes with frequency across the panel.

21. The speaker of claim 1, in which at least some suspension pins or components are formed as strips of components.

22. The speaker of claim 1, in which suspension pins of different design and compliance serve to limit the excursion of the speaker diaphragm to a different degree in forward or reverse excursion and in different positions across the area of the speaker.

23. The speaker of claim 2, in which bosses are used in the support frame and/or in a clamp ring.

24. The speaker of claim 23 in which the support frame has bosses whose height and shape determine the position of the diaphragm.

25. The speaker of claim 2, (i) in which a clamp ring has bosses whose height and shape may determine the position of the diaphragm; or (ii) in which the support frame has bosses whose height determines the distance between the support frame and the diaphragm and the preload of the suspension pins on the diaphragm; or (iii) in which a clamp ring has bosses whose height determines the distance between a clamp ring and the diaphragm and the preload of the suspension pins on the diaphragm.

26. The speaker of claim 2, (i) in which the support frame is made of metal, rubber, glass, plastic, carbon fibre, Kevlar or a composite of these materials; or (ii) in which a clamp is made of metal, rubber, glass, plastic, carbon fibre, Kevlar or a composite of these materials; or (iii) in which the diaphragm is a DML panel that is made of paper, wood, metal, glass, plastic, carbon fibre, kevlar or a composite of these materials; or (iv) in which the diaphragm is a speaker cone that is made of paper, wood, metal, glass, plastic, carbon fibre, kevlar or a composite of these materials.

27. The speaker of claim 1, (i) in which the diaphragm includes a dynamic speaker cone; or (ii) in which the diaphragm includes a dynamic speaker cone diaphragm that is circular, square or rectangular; or (iii) in which the diaphragm includes a panel of a DML, or distributed mode loudspeaker.

28. The speaker of claim 1, in which the speaker is mounted in a smartphone, mp3 or other personal digital music player, or smartwatch or other type of portable, personal device.

29. The speaker of claim 1, in which the speaker is mounted in a laptop or desktop device or automotive system.

30. A speaker comprising an electroacoustic transducer diaphragm and multiple suspension pins or suspension components, in which the electroacoustic transducer diaphragm is mounted between the multiple suspension pins or suspension components, in which the multiple suspension pins or suspension components provide mechanical support and acoustic isolation to the electroacoustic transducer diaphragm, in which at least some of the suspension pins or components are configured with a compliance and/or mass selected to control the movement or acoustic behaviour of the diaphragm.

31. A speaker comprising an electroacoustic transducer diaphragm and multiple suspension pins or suspension components, in which the electroacoustic transducer diaphragm is mounted between the multiple suspension pins or suspension components, in which the multiple suspension pins or suspension components provide mechanical support and acoustic isolation to the electroacoustic transducer diaphragm, the speaker including a support frame, in which the electroacoustic transducer diaphragm is suspended from or between the support frame by the multiple suspension pins or suspension components, the speaker including damping pins, in which a damping pin or a plurality of damping pins are placed into the support frame or an element attached to the support frame, in which the damping pin is positioned to alter the modal behaviour of the diaphragm, or in which the damping pins are positioned to alter the modal behaviour of the diaphragm.

32. A speaker comprising an electroacoustic transducer diaphragm and multiple suspension pins or suspension components, in which the electroacoustic transducer diaphragm is mounted between the multiple suspension pins or suspension components, in which the multiple suspension pins or suspension components provide mechanical support and acoustic isolation to the electroacoustic transducer diaphragm, the speaker including a support frame, in which the electroacoustic transducer diaphragm is suspended from or between the support frame by the multiple suspension pins or suspension components, the speaker including damping pins, in which the position of at least some suspension pins or components provides reduced clustering of modes.

33. A speaker comprising an electroacoustic transducer diaphragm and multiple suspension pins or suspension components, in which the electroacoustic transducer diaphragm is mounted between the multiple suspension pins or suspension components, in which the multiple suspension pins or suspension components provide mechanical support and acoustic isolation to the electroacoustic transducer diaphragm, the speaker including a support frame, in which the electroacoustic transducer diaphragm is suspended from or between the support frame by the multiple suspension pins or suspension components, (i) in which the support frame has bosses whose height determines the distance between the support frame and the diaphragm and the preload of the suspension pins on the diaphragm; or (ii) in which a clamp ring has bosses whose height determines the distance between a clamp ring and the diaphragm and the preload of the suspension pins on the diaphragm.

* * * * *